US008722596B2

(12) United States Patent
Umehara et al.

(10) Patent No.: US 8,722,596 B2
(45) **Date of Patent: *May 13, 2014**

(54) ADDITIVE FOR LUBRICATING OIL AND LUBRICATING OIL COMPOSITION CONTAINING SAME

(75) Inventors: Kazuhiro Umehara, Tokyo (JP); Kenji Yamamoto, Tokyo (JP)

(73) Assignee: Adeka Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/581,710

(22) PCT Filed: Mar. 24, 2011

(86) PCT No.: PCT/JP2011/057183

§ 371 (c)(1),
(2), (4) Date: Aug. 29, 2012

(87) PCT Pub. No.: WO2011/118708

PCT Pub. Date: Sep. 29, 2011

(65) Prior Publication Data

US 2012/0329693 A1 Dec. 27, 2012

(30) Foreign Application Priority Data

Mar. 26, 2010 (JP) ..... 2010-071433

(51) Int. Cl.

| | |
|---|---|
| ***C10M 137/10*** | (2006.01) |
| ***C07F 9/02*** | (2006.01) |
| ***C07F 9/06*** | (2006.01) |
| ***C07F 9/09*** | (2006.01) |

(52) U.S. Cl.
USPC ..... 508/423; 558/162

(58) Field of Classification Search
USPC ..... 508/423; 558/162
See application file for complete search history.

(56) References Cited

U.S. PATENT DOCUMENTS 4,800,030 A * 1/1989 Kaneko et al. ..... 508/423
5,560,849 A * 10/1996 Shankwalkar et al. ..... 508/423

FOREIGN PATENT DOCUMENTS

| | | |
|---|---|---|
| JP | 9-255877 | 9/1997 |
| JP | 2000-34397 | 2/2000 |
| JP | 2007-77356 | 3/2007 |
| WO | 03/016402 | 2/2003 |

OTHER PUBLICATIONS

Supplementary European Search Report dated Nov. 6, 2013 issued in corresponding European Application No. 11759513.2.

* cited by examiner

*Primary Examiner* — Vishal Vasisth

(74) *Attorney, Agent, or Firm* — Wenderoth, Lind & Ponack, L.L.P.

(57) ABSTRACT

Provided are an additive for lubricating oil, including a compound represented by the following general formula (1) as an essential component, and a lubricating oil composition blending same:

[Chem. 1]

(1)

where $R^1$, $R^3$, $R^5$, and $R^7$ each independently represent an alkyl group having 1 to 20 carbon atoms, $R^2$, $R^4$, $R^6$, and $R^8$ each independently represent a hydrogen atom or an alkyl group having 1 to 20 carbon atoms, A represents a hydrocarbon group having 2 to 20 carbon atoms, and n represents a number from 1 to 10.

1 Claim, No Drawings

ADDITIVE FOR LUBRICATING OIL AND LUBRICATING OIL COMPOSITION CONTAINING SAME

This application is a 371 of PCT/JP2011/057183, filed Mar. 24, 2011.

TECHNICAL FIELD

The present invention relates to an additive for lubricating oil that exerts a high wear-preventing effect without impairing a friction-reducing effect when used as an additive in a lubricating oil, and a lubricating oil composition containing the additive.

BACKGROUND ART

Machines such as automobiles and machine tools have become more sophisticated in functionality in recent years, and performance required for a lubricating oil to be used in such machines has also become more sophisticated. Although various functions and effects are required for the lubricating oil, an extremely high degree of performance concerning wear prevention has been required for the lubricating oil because the speeds and pressures of the machines have been increasing. An anti-wear agent is typically added as an additive to the lubricating oil for the wear prevention. Such anti-wear agent is an additive that has been well known from long past, and a phosphorus- or sulfur-based compound, or a combination of these compounds has generally been used for the wear prevention.

For example, Patent Document 1 discloses a diesel engine oil for an engine with an exhaust gas recirculation apparatus, the oil being characterized in that a lubricating oil base oil (a mineral oil or a synthetic oil) is blended with 5.8 to 8.3 mass % of a calcium alkyl salicylate (6.0 mass % of calcium (Ca) content) having a total basic number (TBN) of 165 mgKOH/g as a detergent, 0.09 to 0.13 mass % in terms of zinc (Zn) of a primary alkyl-type zinc dithiophosphate as an antioxidant-cum-anti-wear agent, and 0.02 to 0.04 mass % in terms of molybdenum (Mo) of an oil-soluble oxymolybdenum dialkyl dithiophosphate as a friction modifier-cum-anti-wear agent.

In addition, Patent Document 2 discloses an anti-wear agent for a low-phosphorus lubricant formed of a composition having the following chemical structure:

[Chem. 1]

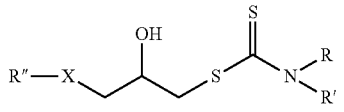

[where R and R' may each represent hydrogen or an alkyl group, and in this case, at least one of R and R' represents an alkyl group, and R" represents an alkyl group, R'''$OCOCH_2$, or R'''$OCOCH_2CH_2$ (where R''' represents an alkyl group and X represents S)].

Further, Patent Document 3 discloses a super tractor oil universal lubricating composition characterized in that:

(a) the lubricating composition contains an oil of lubricating viscosity having a viscosity index of at least about 95 and blending additive components containing (i) at least one metal detergent, (ii) at least one phosphorus-based anti-wear agent, and (iii) at least one oil-soluble molybdenum compound;

(b) the ratio between a metal content (ppm) based on the total weight of the lubricating composition and the total basic number (mg KOH/g) of the lubricating composition is about 210 to about 450 (ppm/mg KOH/g);

(c) the ratio between the metal content (ppm) based on the total weight of the lubricating oil composition and a phosphorus content (ppm) based on the total weight of the lubricating composition is about 5.0 to about 20.0 (ppm/ppm); and (d) the ratio between the phosphorus content (ppm) based on the total weight of the lubricating composition and a molybdenum content (ppm) based on the total weight of the lubricating composition is about 0.5 to about 80.0 (ppm/ppm).

In addition, in recent years, an additionally high wear-preventing effect has been desired, and for example, the applicant of the present application has already proposed that the use of a condensed phosphate can exert a higher wear-preventing effect than that of a conventionally known phosphorus-based anti-wear agent (Japanese Patent Application No. 2010-21022).

PRIOR ART DOCUMENT

Patent Document

Patent Document 1: JP 07-207290 A

Patent Document 2: JP 2003-183247 A

Patent Document 3: JP 2008-174742 A

SUMMARY OF THE INVENTION

Problem to be Solved by the Invention

However, the wear-preventing effect of each of the anti-wear agents described in Patent Documents 1 to 3 is insufficient, and hence an additive for lubricating oil that exerts an additionally high effect has been demanded in the market.

Therefore, a problem to be solved by the invention is to provide an additive for lubricating oil that exerts a higher wear-preventing effect and a higher friction-reducing effect than those of conventionally known anti-wear agents, and a lubricating oil composition having blended therein the additive.

Means for Solving the Problem

The inventors of the present invention have intensively studied in order to solve the problem, and as a result, the present invention has been achieved.

That is, the present invention provides an additive for a lubricating oil additive, including a compound represented by the following general formula (1) as an essential component, and a lubricating oil composition blending said additive:

[Chem. 2]

(1)

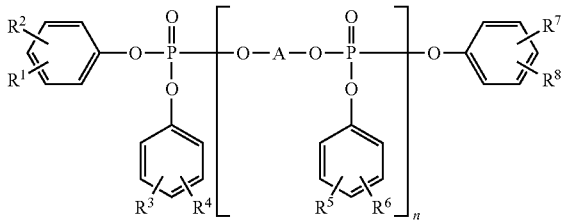

where $R^1$, $R^3$, $R^5$, and $R^7$ each independently represent an alkyl group having 1 to 20 carbon atoms, $R^2$, $R^4$, $R^6$, and $R^8$ each independently represent a hydrogen atom or an alkyl group having 1 to 20 carbon atoms, A represents a hydrocarbon group having 2 to 20 carbon atoms, and n represents a number from 1 to 10.

Effects of the Invention

An effect of the present invention lies in the provision of an additive for lubricating oil that exerts a high wear-preventing effect and a high friction-reducing effect, and a lubricating oil composition blending said additive.

BEST MODE FOR CARRYING OUT THE INVENTION

An additive for lubricating oil of the present invention is characterized by containing a compound represented by the following general formula (1) as an essential component:

[Chem. 3]

(1)

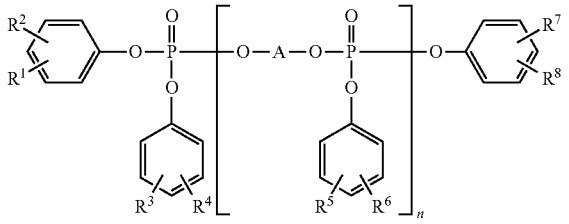

In the general formula (1), $R^1$, $R^3$, $R^5$, and $R^7$ each independently represent an alkyl group having 1 to 20 carbon atoms, and $R^2$, $R^4$, $R^6$, and $R^8$ each independently represent a hydrogen atom or an alkyl group having 1 to 20 carbon atoms. Examples of such an alkyl group include a methyl group, an ethyl group, a propyl group, an isopropyl group, a butyl group, an isobutyl group, a secondary butyl group, a tertiary butyl group, a pentyl group, an amyl group, an isoamyl group, a hexyl group, a heptyl group, an isoheptyl group, an octyl group, an isooctyl group, a 2-ethylhexyl group, a nonyl group, an isononyl group, a decyl group, a dodecyl (lauryl) group, a tridecyl group, a tetradecyl(myristyl) group, a pentadecyl group, a hexadecyl(palmityl) group, a heptadecyl group, an octadecyl group (stearyl) group, a nonadecyl group, and an icosyl group. $R^1$, $R^3$, $R^5$, and $R^7$ each represent preferably an alkyl group having 1 to 9 carbon atoms, more preferably an alkyl group having 1 to 5 carbon atoms, still more preferably a methyl group. In addition, $R^2$, $R^4$, $R^6$, and $R^8$ each represent preferably an alkyl group having 1 to 9 carbon atoms or a hydrogen atom, more preferably an alkyl group having 1 to 5 carbon atoms or a hydrogen atom, still more preferably a methyl group or a hydrogen atom, most preferably a methyl group.

In the general formula (1), A represents a hydrocarbon group having 2 to 20 carbon atoms, and examples of such group include an alkylene group, a cycloalkylene group, and a hydrocarbon group containing one or more arylene groups.

Examples of the alkylene group include an ethylene group, a propylene group, a butylene group, a pentylene group, a hexylene group, a heptylene group, an octylene group, a nonylene group, a decylene group, an undecylene group, a dodecylene group, a tetradecylene group, a hexadecylene group, an octadecylene group, and an icosalene group.

Examples of the cycloalkylene group include a cyclopropylene group, a cyclobutylene group, a cyclopentylene group, a cyclohexylene group, a cycloheptylene group, a cyclooctylene group, a dicyclopentylene group, and a tricyclopentylene group.

Examples of the hydrocarbon group containing one or more arylene groups include a group represented by a general formula (2), a group represented by a general formula (3), a group represented by a general formula (4), a 1,2-diphenylethylene group, and a naphthylene group. In the case of the group represented by the general formula (2), three structures, i.e., an ortho body, a meta body, and a para body are obtained depending on bonding sites. Any one of the structures is permitted, and the structural difference does not lead to a change in performance. Here, preferably represents a group containing one or more aryl groups out of those groups because a wear-preventing effect is high. Also, represents more preferably the group represented by any one of the general formula (2), the general formula (3), and the general formula (4), still more preferably the group represented by the general formula (2).

[Chem. 4]

(2)

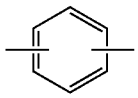

(3)

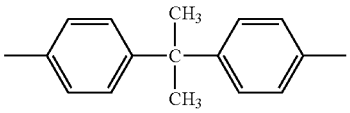

(4)

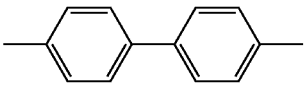

In the general formula (1) n is a number from 1 to 10 and represents a degree of polymerization, and is preferably a number from 1 to 5 in order that the additive for lubricating oil of the present invention may be caused to sufficiently exert its wear-preventing effect. It should be noted that the value for n can be calculated from the measurement results of high performance liquid chromatography.

A compound where n of the compound represented by the general formula (1) is zero or a compound where n is 11 or more are included as impurities in the lubricating oil additive of the present invention in some cases. The content of such impurity is preferably 10 parts by mass or less, more preferably 5 parts by mass or less, still more preferably 2 parts by mass or less with respect to 100 parts by mass of the lubricating oil additive of the present invention. A content in excess of 10 parts by mass is not preferred because it reduces the wear-preventing effect of the additive for lubricating oil of the present invention.

In addition, the average of n, i.e., an average degree of polymerization is calculated from the molar ratio of the compound represented by the general formula (1). In the case of, for example, a composition where the molar ratio of a compound in which n=1 is 50 mol % and the molar ratio of a compound in which n=2 is 50 mol %, the average degree of polymerization is 1.5.

The average of n of the compound represented by the general formula (1), i.e., the average degree of polymerization, which is not particularly limited, is preferably 1.0 to 4.0 in order that the wear-preventing effect may be improved, and is more preferably 1.0 to 2.0. An average degree of polymerization in excess of 4.0 is not preferred because the additive may be hard to dissolve in a base oil or the wear-preventing effect may be reduced.

It should be noted that when compounds where n in the general formula (1) is zero or where n is 11 or more are included, a value for n of such compounds are not factored into the calculation of the average of n of the additive for lubricating oil of the present invention, i.e., the average degree of polymerization.

Any one of the known methods may be employed as a method of producing the compound represented by the general formula (1), and the target product can be obtained by, for example, one of the following methods:

Method 1

When a compound wherein A is represented by the general formula (2), $R^1$, $R^3$, $R^5$ and $R^7$ represent a methyl group, $R^2$, $R^4$, $R^6$ and $R^8$ represent a hydrogen atom, and the value for n in the general formula (1) ranges from 1 to 5 is produced, said compound can be obtained by reacting 1 mol of 1,3-benzenediol with 2 mol of phosphorus oxychloride, and then, reacting obtained product with 4 mol of cresol. In this case, compounds having different values for n can be produced by changing the molar ratio of each raw material. At whatever molar ratio the synthesis may be performed, a mixture of compounds having different values for n is typically obtained unless purification is performed.

Method 2

When a compound wherein A is represented by the general formula (2), $R^1$, $R^3$, $R^5$ and $R^7$ represent a methyl group, $R^2$, $R^4$, $R^6$ and $R^8$ represent a hydrogen atom, and the value for n in the general formula (1) is 1 is produced, the compound can be obtained by reacting 1 mol of 1,3-benzenediol with 2 mol of dicresyl chlorophosphate.

Next, a lubricating oil composition of the present invention is obtained by blending the additive for the lubricating oil of the present invention in an amount of 0.01 to 10 parts by mass, preferably 0.01 to 7 parts by mass, more preferably 0.02 to 5 parts by mass with respect to 100 parts by mass of a base oil. An excessively small blending amount is not preferred because the additive may be unable to exert its effect as an anti-wear agent. An excessively large blending amount is not preferred because insoluble matter may appear or an effect commensurate with the blending amount cannot be obtained in some cases.

The base oil that can be used is exemplified by a mineral oil, a synthetic oil and a mixture thereof, and more specific examples thereof include: synthetic oils such as a poly-α-olefin, an ethylene-α-olefin copolymer, a polybutene, an alkylbenzene, an alkylnaphthalene, a polyalkylene glycol, a polyphenyl ether, an alkyl-substituted diphenyl ether, a polyol ester, an aromatic ester, a hindered ester having a pentaerythritol skeleton, a dibasic ester, a carbonate, a silicone oil, a fluorinated oil, and gas to liquids (GTLs); a paraffin-based mineral oil, a naphthene-based mineral oil, and purified mineral oils obtained by purifying these mineral oils. Those base oils may be used each alone or may be used as a mixture. Of those base oils, because of their high wear-improving effects, a poly-α-olefin, an ethylene-α-olefin copolymer, a polybutene, an alkylbenzene, an alkylnaphthalene, an aromatic ester, a hindered ester, a dibasic ester, a paraffin-based mineral oil, a naphthene-based mineral oil, and GTLs are preferred, a poly-α-olefin, an aromatic ester, a hindered ester, a dibasic ester, a paraffin-based mineral oil, a naphthene-based mineral oil, and GTLs are more preferred, and a poly-α-olefin, an aromatic ester, a dibasic ester, a paraffin-based mineral oil, and a naphthene-based mineral oil are still more preferred.

When the poly-α-olefin is used, the poly-α-olefin is derived from at least one selected from α-olefins each having 8 to 20 carbon atoms and has a kinematic viscosity at 100° C. of 1 to 300 mm/sec. In addition, a preferred ethylene-α-olefin copolymer is as described below. The ethylene-α-olefin copolymer contains a constitutional unit derived from at least one selected from α-olefins each having 8 to 20 carbon atoms at a content of 50 to 99 mass % and a constitutional unit derived from ethylene at a content of 1 to 50 mass %, and has a kinematic viscosity at 100° C. of 1 to 300 m/sec. In addition, the mineral oil is more preferably as described below. The mineral oil is subjected to purification such as hydrogenation purification, solvent deasphalting, solvent extraction, solvent dewaxing, contact dewaxing, hydrocracking, sulfuric acid washing, or a clay treatment, and has a kinematic viscosity at 100° C. of 1 to 50 m/sec. A kinematic viscosity of the base oil at 100° C. in excess of 300 mm/sec is not preferred because its low-temperature viscosity characteristic may deteriorate. A kinematic viscosity of less than 1 is not preferred because the formation of an oil film at a lubrication site is insufficient and hence lubricity may be poor or the extent of metal wear may enlarge. In addition, when the mineral oil is used as the base oil, its viscosity index is preferably 90 or more, more preferably 100 or more.

Further, the addition of a known additive for lubricating oil is not prohibited in the lubricating oil composition of the present invention. For example, an anti-wear agent other than the lubricating oil additive of the present invention, a friction modifier, a metal-based detergent, an ashless dispersant, an antioxidant, a friction-reducing agent, a viscosity index improver, a pour point depressant, a rust inhibitor, a corrosion inhibitor, an extreme pressure additive, an anti-foaming agent, a metal deactivator, an emulsifier, an anti-emulsifier, and an antifungal agent may be added depending on the intended use as long as an effect of the present invention is not impaired.

Examples of the anti-wear agent other than the additive for the lubricating oil of the present invention include sulfur-based additives such as a sulfurized oil and fat, olefin polysulfide, and dibenzyl sulfide; phosphorus-based compounds such as monooctyl phosphate, tributyl phosphate, triphenyl phosphite, tributyl phosphite, and a thiophosphate; and organometal compounds such as a metal salt of thiophosphoric acid, a metal salt of thiocarbamic acid, a metal salt of an acidic phosphoric acid ester, and zinc dithiophosphate. Such anti-wear agent is blended in an amount of preferably 0.01 to 3 mass %, more preferably 0.05 to 2 mass % with respect to the base oil.

Examples of the friction modifier include: higher alcohols such as oleyl alcohol and stearyl alcohol; fatty acids such as oleic acid and stearic acid; esters such as oleyl glycerin ester, steryl glycerin ester, and lauryl glycerin ester; amides such as lauryl amide, oleyl amide, and stearyl amide; amines such as laurylamine, oleylamine, stearylamine, and an alkyldiethanolamine; and ethers such as lauryl glycerin ether and oleyl glycerin ether. Such friction modifier is blended in an amount of preferably 0.1 to 5 mass %, more preferably 0.2 to 3 mass % with respect to the base oil.

Examples of the metal-based detergent include sulfonates, phenates, salicylates, and phosphates of calcium, magnesium, and barium, and perbasic salts thereof. Of those, perbasic salts are preferred, and a perbasic salt having a total basic number (TBN) of 30 to 500 mg KOH/g out of the perbasic salts is more preferred. Such metal-based detergent is blended in an amount of preferably 0.5 to 10 mass %, more preferably 1 to 8 mass % with respect to the base oil.

Examples of the ashless dispersant include succinimide, a succinate, and benzylamine to each of which an alkyl group or an alkenyl group has been added and each of which has a weight-average molecular weight of about 500 to 3,000, and boron-denatured products thereof. Such ashless dispersant is blended in an amount of preferably 0.5 to 10 mass %, more preferably 1 to 8 mass % with respect to the base oil.

Examples of the antioxidant include: phenol-based antioxidants such as 2,6-ditertiary butylphenol (hereinafter, tertiary butyl is abbreviated to t-butyl), tris{(3,5-di-t-butyl-4-hydroxyphenyl)propionyl-oxyethyl}isocyanurate, tris(3,5-di-t-butyl-4-hydroxyphenyl)isocyanurate, 1,3,5-tris(3,5-di-t-butyl-4-hydroxybenzyl)isocyanurate, 1,3,5-tris(4-t-butyl-3-hydroxy-2,6-dimethylbenzyl)isocyanurate, 6-(4-hydroxy-3,5-di-t-butylanilino)-2,4-bis(octylthio)-1,3,5-triazine, 3,5-di-t-butyl-4-hydroxy-benzyl-phosphodiester, 3,9-bis-[1,1-dimethyl-2-{β-(3-t-butyl-4-hydroxy-5-methylphenyl) propionyloxy}ethyl]-2,4,8,10-tetraoxaspiro[5,5]undecane, and 1,1,3-tris(2-methyl-4-hydroxy-5-t-butylphenyl)butane; and phenothiazine-based antioxidants such as phenothiazine, N-methylphenothiazine, N-ethylphenothiazine, 3,7-dioctylphenothiazine, a phenothiazine carboxylate, and phenoselenazine. Such antioxidant is blended in an amount of preferably 0.01 to 5 mass %, more preferably 0.05 to 4 mass % with respect to the base oil.

Examples of the friction-reducing agent include organic molybdenum compounds such as sulfurized oxymolybdenum dithiocarbamate and sulfurized oxymolybdenum dithiophosphate. Such friction-reducing agent is blended in an amount of preferably 30 to 2,000 ppm by mass, more preferably 50 to 1,000 ppm by mass in terms of molybdenum content with respect to the base oil.

Examples of the viscosity index improver include a poly (C1 to C18)alkyl(meth)acrylate, ahydroxyethyl(meth)acrylate/(C1 to C18)alkyl(meth)acrylate copolymer, a diethylaminoethyl(meth)acrylate/(C1 to C18)alkyl(meth)acrylate copolymer, an ethylene/(C1 to C18)alkyl(meth)acrylate copolymer, a polyisobutylene, a polyalkylstyrene, an ethylene/propylene copolymer, a styrene/maleic acid ester copolymer, and a styrene/isoprene hydrogenated copolymer. Alternatively, a dispersion-type or multi-functional viscosity index improver to which dispersing performance has been imparted may be used. Its weight-average molecular weight is about 10,000 to 1,500,000, preferably about 20,000 to 500,000. Such viscosity index improver is blended in an amount of preferably 0.1 to 20 mass %, more preferably 0.3 to 15 mass % with respect to the base oil.

Examples of the pour point depressant include a polyalkyl (meth)acrylate, a polyalkylstyrene, a polystyrene-(meth) acrylate, a polyvinyl acetate, and a polyethylene-vinyl acetate. Its weight-average molecular weight is about 1,000 to 100,000, preferably about 5,000 to 50,000. Such pour point depressant is blended in an amount of preferably 0.005 to 3 mass %, more preferably 0.01 to 2 mass % with respect to the base oil.

Examples of the rust inhibitor include sodium nitrite, an oxidized paraffin wax calcium salt, an oxidized paraffin wax magnesium salt, a beef tallow fatty acid alkali metal salt, alkaline earth metal salt, or amine salt, an alkenyl succinic acid or an alkenyl succinic acid half ester (the molecular weight of the alkenyl group is about 100 to 300), a sorbitan mono-ester, nonylphenolethoxylate, and a lanolin fatty acid calcium salt. Such rust inhibitor is blended in an amount of preferably 0.01 to 3 mass %, more preferably 0.02 to 2 mass % with respect to the base oil.

Examples of the corrosion inhibitor include benzotriazole, benzimidazole, benzothiazole, benzothiadiazole, and a tetraalkylthiuram disulfide. Such corrosion inhibitor is blended in an amount of preferably 0.01 to 3 mass %, more preferably 0.02 to 2 mass % with respect to the base oil.

Examples of the anti-foaming agent include a polydimethylsilicone, trifluoropropylmethylsilicone, colloidal silica, a polyalkyl acrylate, a polyalkyl methacrylate, an alcohol ethoxy/propoxylate, a fatty acid ethoxy/propoxylate, and a sorbitan partial fatty acid ester. Such anti-foaming agent is blended in an amount of preferably 0.001 to 0.1 mass %, more preferably 0.001 to 0.01 mass % with respect to the base oil.

It should be noted that compounds represented by the following general formulae included in the category of the antioxidant are excluded from the category of the additive for lubricating oil:

[Chem. 5]

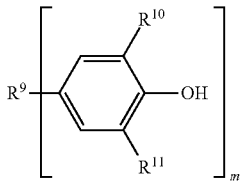

(where $R^9$ represents a hydrocarbon group having 1 to 30 carbon atoms, and the hydrocarbon group may be interrupted with an ether group, a sulfide group, a ketone group, an ester group, a carbonate group, an amide group, or an imino group, $R^{10}$ and $R^{11}$ each represent an alkyl group having 1 to 20 carbon atoms, and m represents a number of 1 to 4);

[Chem. 6]

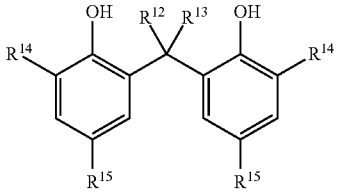

(where $R^{12}$ and $R^{13}$ each independently represent a hydrogen atom or an alkyl group having 1 to 20 carbon atoms, $R^{14}$ represents an alkyl group having 1 to 6 carbon atoms or a cycloalkyl group having 6 carbon atoms, and $R^{15}$ represents an alkyl group having 1 to 20 carbon atoms);

[Chem. 7]

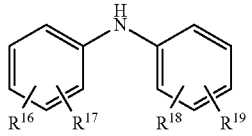

(where $R^{16}$ to $R^{19}$ each independently represent a hydrogen atom or an alkyl group having 1 to 20 carbon atoms); and

[Chem. 8]

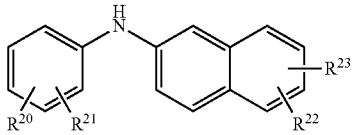

(where $R^{20}$ to $R^{23}$ each independently represent a hydrogen atom or an alkyl group having 1 to 20 carbon atoms).

The lubricating oil composition of the present invention can be used in any application as long as the application is an application in which a lubricating oil can be used. Examples of such applications include engine oil, lubricating oil for transmissions, gear oil, turbine oil, operating oil, refrigerating machine oil, compressor oil, vacuum pump oil, bearing oil, sliding surface oil, rock drill oil, metal cutting oil, plastic working oil, heat treatment oil, grease, and processing oil.

EXAMPLES

Hereinafter, the present invention is specifically described by way of examples. It should be noted that the terms "%" and "ppm" in the following examples and the like refer to "mass %" and "ppm by mass," respectively unless otherwise stated.

The following base oils were used in tests.

(P): A mixture obtained by reacting and esterifying pentaerythritol with a mixture of isoheptanoic acid and normal octanoic acid (a molar ratio of isoheptanoic acid and normal octanoic acid=1/1) with pentaerythritol Viscosity Index: 111, Kinematic Viscosity at 100° C.: 5.8 $mm^2$/sec (Q): A commercially available mineral oil (Super Oil N22 available from Nippon Oil Corporation: paraffin-based mineral oil)

Viscosity Index: 102, Kinematic Viscosity at 100° C.: 4.4 $mm^2$/sec A-1: A mixture of (P) and (Q) having 1/9 of a mass ratio (P)/(Q)

Viscosity Index: 102, Kinematic Viscosity at 100° C.: 4.5 $mm^2$/sec

Synthesis examples of the inventive and comparative additives for the lubricating oil are described below.

Synthetic Example 1

X-1

A 1,000-ml four-necked flask provided with a stirring machine, a thermometer, a dropping funnel, and a nitrogen-introducing pipe was mounted with a condenser to which a water scrubber had been connected, and then 2.0 mol (244 g) of 2,6-dimethylphenol, and 0.016 mol (1.5 g) of magnesium chloride were loaded into the resultant reactor. The atmosphere in the reactor was replaced with nitrogen and then its temperature was increased to 120° C. 1.0 Mole (153 g) of phosphorus oxychloride was dropped into the reactor at that temperature over 2 hours. After the completion of the dropping, the temperature was increased to 180° C. over 2 hours. Thus, di(2,6-xylyl)phosphorochloridate was obtained. The temperature in the flask was cooled to 20° C., and then 0.5 mol (55 g) of 1,3-benzenediol and 0.016 mol (1.5 g) of magnesium chloride were loaded into the flask. The temperature was increased to 180° C. over 2 hours and then the mixture was aged for 2 hours. After that, the catalyst was removed by an ordinary method and then the remainder was dried at 140° C. under reduced pressure. Thus, X-1 represented by the following general formula (5) was obtained.

[Chem. 9]

(5)

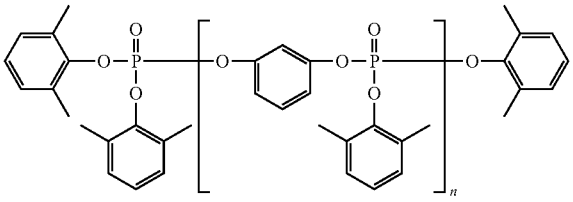

Products of the present invention X-2 and X-3 were each produced by the following production method.

Synthesis Example 2

X-2 and X-3 represented by general formula (5) and general formula (6), respectively, and having average degrees of polymerization shown in Table 1 below were each produced by the same production method as that of X-1 except that 4-pentylphenol or 4-nonylphenol was used instead of 2,6-dimethylphenol in the synthesis of X-1.

[Chem. 10]

(6)

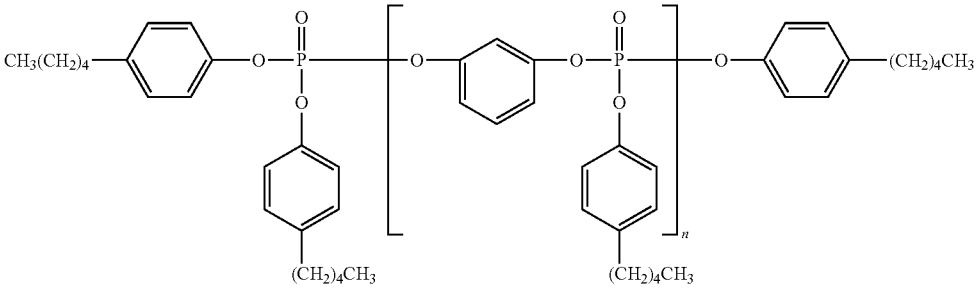

-continued

[Chem. 11]

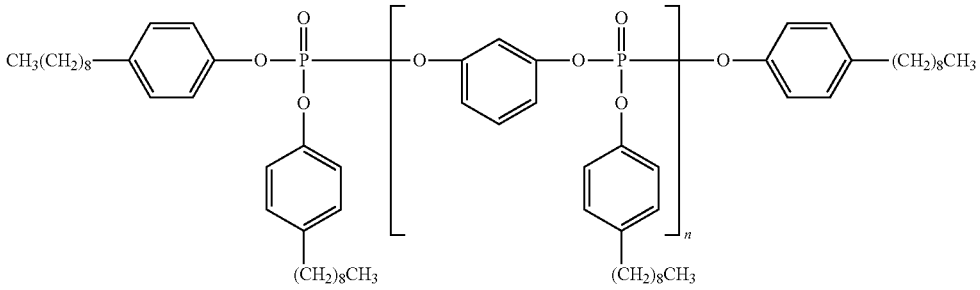

(7)

Table 1 below shows the composition and average degree of polymerization of each component (X).

TABLE 1

| Component (X) | General formula | Degree of polymerization (molar ratio) n = 1 | n = 2 | n = 3 to 10 | Average degree of polymerization |
|---|---|---|---|---|---|
| X-1 | General formula (5) | 95 | 4 | 1 | 1.06 |
| X-2 | General formula (6) | 93 | 6 | 1 | 1.08 |
| X-3 | General formula (7) | 95 | 4 | 1 | 1.06 |

Comparative Product <Y-1>

Manufactured by Tokyo Chemical Industry Co., LTD., product name: triphenyl phosphate

[Chem. 12]

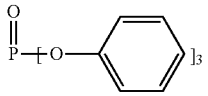

(8)

Comparative Product 2 <Y-2>

Manufactured by Tokyo Chemical Industry Co., LTD., product name: cresyl diphenyl phosphate

[Chem. 13]

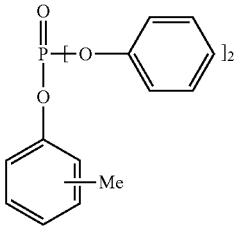

(9)

A test method and test conditions for a friction test and a wear resistance test are described below.

(Test Method)

100.0 g of a base oil and 0.1 part by mass of the additive for the lubricating oil were added to a 200-ml beaker, and then the mixture was stirred at 90° C. for 1 hour. After the mixture had been left at rest at 25° C. for 3 hours, the friction test and the wear resistance test were performed under the following conditions.

(Test Conditions)

A coefficient of friction in a ball-on-plate reciprocating sliding and the wear track diameter (mm) of a ball after the test were compared using a load fluctuation-type friction and wear tester (HEIDON TYPE: HHS2000; manufactured by Shinto Scientific Co., Ltd.). A smaller coefficient of friction means higher friction resistance and a smaller wear track diameter means higher wear resistance.

Load: 9.8 N

Maximum contact pressure: 0.85 GPa

Sliding speed: 10 mm/sec

Amplitude: 10 mm

Test distance: 5,000 rounds

Test temperature: 80° C.

Test material: ball: ϕ1.27 mm (½ inch) SUJ2

Test material: plate: SUJ2

Table 2 shows the results of the friction test and the wear resistance test.

TABLE 2

| | Lubricating oil additive | Coefficient of friction | Wear track diameter (mm) |
|---|---|---|---|
| Example 1 | X-1 | 0.13 | 0.28 |
| Example 2 | X-2 | 0.13 | 0.32 |
| Example 3 | X-3 | 0.13 | 0.34 |
| Comp. Example 1 | — | 0.14 | 0.46 |
| Comp. Example 2 | Y-1 | 0.15 | 0.36 |
| Comp. Example 3 | Y-2 | 0.14 | 0.37 |

The coefficient of friction of Comparative Example 2 is observed to deteriorate as compared with that of Comparative Example 1 (in the case of no addition). In addition, Comparative Example 3 shows a coefficient of friction on a par with that of Comparative Example 1, and hence no improvement in coefficient of friction is observed. However, each of Examples 1 to 3 can exert wear-preventing performance without adversely affecting the coefficient of friction.

The invention claimed is:

1. An additive for lubricating oil, comprising a base oil and a compound represented by the following formula (I) as an essential component:

[Chem. 1]
(1)
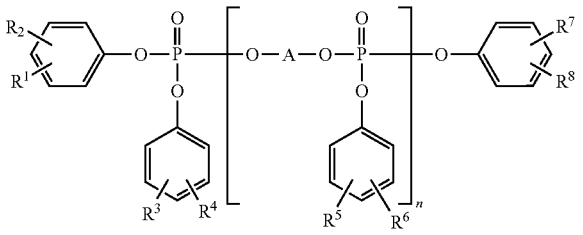
where $R^1$, $R^3$, $R^5$, and $R^7$ each independently represents an alkyl group having 1 to 20 carbon atoms, $R^2$, $R^4$, $R^6$, and $R^8$ each independently represents a hydrogen atom or an alkyl group having 1 to 20 carbon atoms, A represents one of the following formulae (2), (3) or (4),
(2)
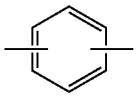
(3)
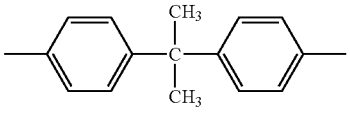
(4)
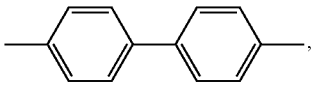
and n represents a number from 1 to 10, wherein an average of n is 1.06 to 2.0.
* * * * *